US007104897B2

(12) United States Patent
Park

(10) Patent No.: US 7,104,897 B2
(45) Date of Patent: Sep. 12, 2006

(54) GOLF SWING TRAINING DEVICE

(76) Inventor: Young Sung Park, 40 Providence St., West Warwick, RI (US) 02893

( * ) Notice: Subject to any disclaimer, the term of this patent is extended or adjusted under 35 U.S.C. 154(b) by 0 days.

(21) Appl. No.: 11/127,593

(22) Filed: May 12, 2005

(65) Prior Publication Data

US 2005/0266929 A1 Dec. 1, 2005

Related U.S. Application Data

(60) Provisional application No. 60/574,910, filed on May 27, 2004.

(51) Int. Cl.
*A63B 69/36* (2006.01)

(52) U.S. Cl. ..... 473/219; 473/226

(58) Field of Classification Search ..... 473/219, 473/226, 235, 324, 330, 331, 332, 333, 349, 473/350

See application file for complete search history.

(56) References Cited

U.S. PATENT DOCUMENTS 780,776 A * 1/1905 Brown ..... 473/327
2,826,417 A * 3/1958 Marcoccio ..... 273/129 R
D212,293 S * 9/1968 Brown, Jr. ..... D21/751
3,649,028 A * 3/1972 Worrell ..... 473/220
3,719,359 A * 3/1973 Evans et al. ..... 473/328
3,720,410 A * 3/1973 Saytar ..... 473/562
4,569,525 A 2/1986 Folger
5,234,217 A 8/1993 Johnson
5,310,188 A 5/1994 Hernberg
5,692,968 A * 12/1997 Shine ..... 473/286
6,402,638 B1 * 6/2002 Kelley ..... 473/330
6,605,006 B1 8/2003 Mason
6,846,246 B1 * 1/2005 Asplund et al. ..... 473/327
2004/0152533 A1 8/2004 Sery

* cited by examiner

*Primary Examiner*—Nini F. Legesse
(74) *Attorney, Agent, or Firm*—Sturm & Fix LLP

(57) ABSTRACT

A golf club for training golfers is disclosed. A specific club head shape encourages the golfer to envision impacting the golf ball with the back of their leading hand. A color system on the golf club handle helps with the release. The heel of the club head is heavier than the toe, promoting an inside-out swing. Additionally, the golf club head is heavier than an average golf club, improving the golfer's strength.

10 Claims, 3 Drawing Sheets

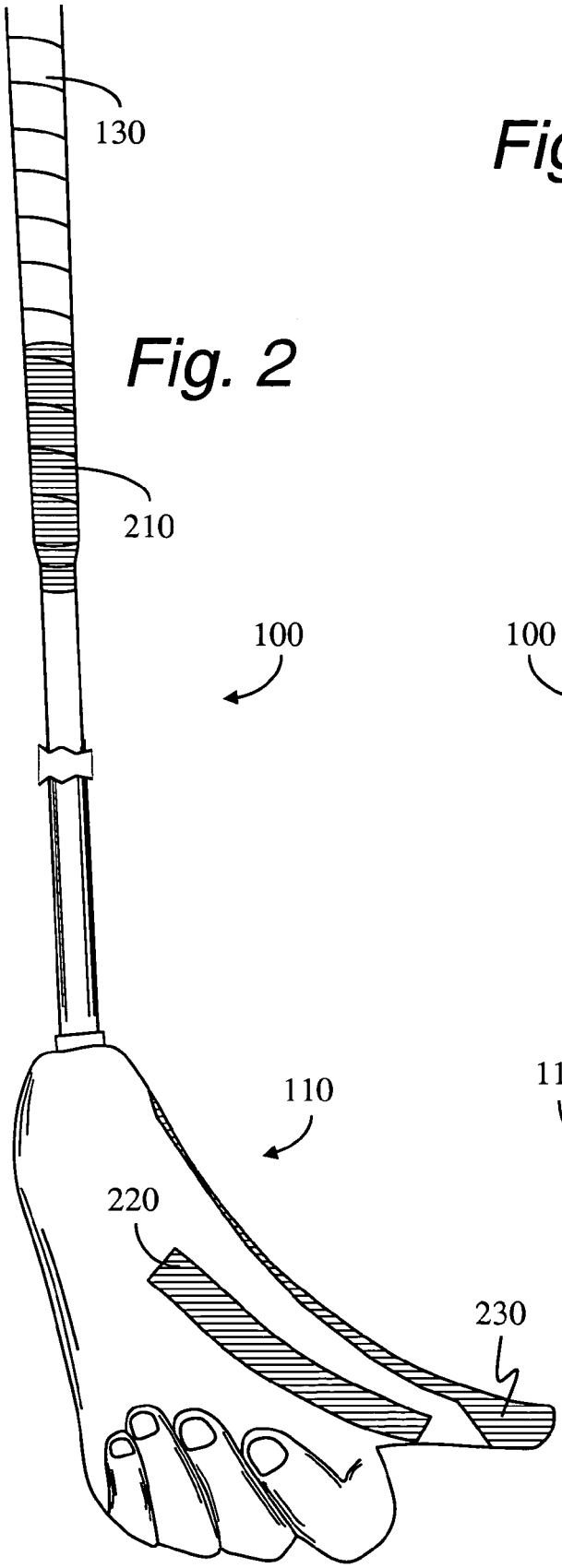
Fig. 2
Fig. 3
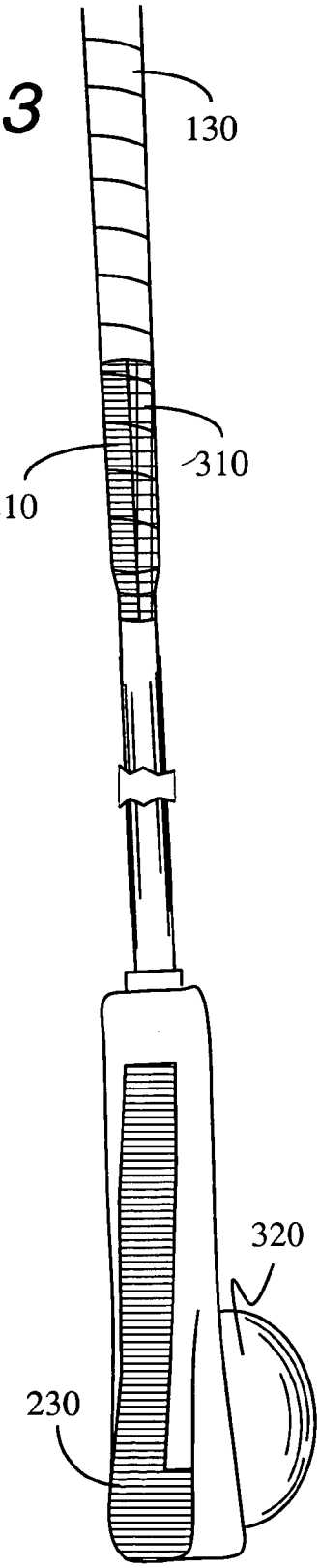

GOLF SWING TRAINING DEVICE

CROSS REFERENCE TO RELATED APPLICATIONS

This application claims the benefit of U.S. Provisional Patent Application Ser. No. 60/574,910 filed May 27, 2004 entitled "Golf Swing Training Device" and incorporates it herein in its entirety.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates generally to a sports training device. More particularly, the present invention is for an improved method and apparatus for improving a player's golf game.

2. Background Art

It is common for golfers to attempt to scoop the golf ball with their golf club. Instead, a golfer should swing their golf club as though they were impacting the golf ball with the back of their leading hand (left hand for a right handed golfer). Additionally, the toe of a golf club head should be rotated faster than the heel. Neither conventional golf clubs nor clubs specifically made for golf training are ideally suited to encourage a learning golfer to practice these three aspects properly.

A golf club swing training device was disclosed in U.S. Pat. No. 4,569,525 by Folger. The Folger invention is made to aid a golfer in the address position, and focuses on line of flight. Folger does not comment on a golfer envisioning striking the ball with the back of his or her leading hand, nor on rotating the toe of the club head faster than the heel.

Therefore, there is a need for an improved training golf club having features to aid a golf trainee in learning a proper swing by envisioning impacting the ball with the back of their leading hand, encouraging a proper release, and rotating the toe of the golf club head faster than the heel.

BRIEF SUMMARY OF THE INVENTION

An object of the present invention is to provide a training golf club having features to encourage a golf trainee to envision impacting the ball with the back of their leading hand. The training golf club of the present invention meets this object by using a novel head shape. The shape is that of the trainee's leading hand: a left hand for a right handed golfer, and a right hand for a left handed golfer. The hand-shaped head is embellished with color coding for visual indications to the trainee when he or she is correctly swinging the club.

Another object is to provide color coding to help a golf trainee learn a proper release. On the handle of the training golf club, two different colors are applied. A first color is applied to the side of the grip corresponding to the "palm" side of the shaped head while a second, different color, easily distinguishable from the first is applied to the side of the grip corresponding to the back side of the hand-shaped training club head. The trainee observes the colors on the handle as well as the color indices on the hand-shaped head to determine the proper release.

Still another object is to utilize a specific weighting method to encourage the rotation of the toe of the golf club head faster than the rotation of the heel of the golf club head. A proper swing includes a rotation of the golf club in a counterclockwise direction for a right handed golfer and clockwise for a left handed golfer. By weighting the heel portion of the hand shaped training golf club head greater than the toe portion, the correct rotation is encouraged.

Other objects, advantages and novel features of the present invention will become apparent from the following detailed description of the invention when considered in conjunction with the accompanying drawings.

BRIEF DESCRIPTION OF THE SEVERAL VIEWS OF THE DRAWINGS

FIG. 2 is a first side elevation view of the training golf club;

FIG. 3 is a front elevation view of the training golf club;

DETAILED DESCRIPTION OF THE INVENTION

Figure 1:
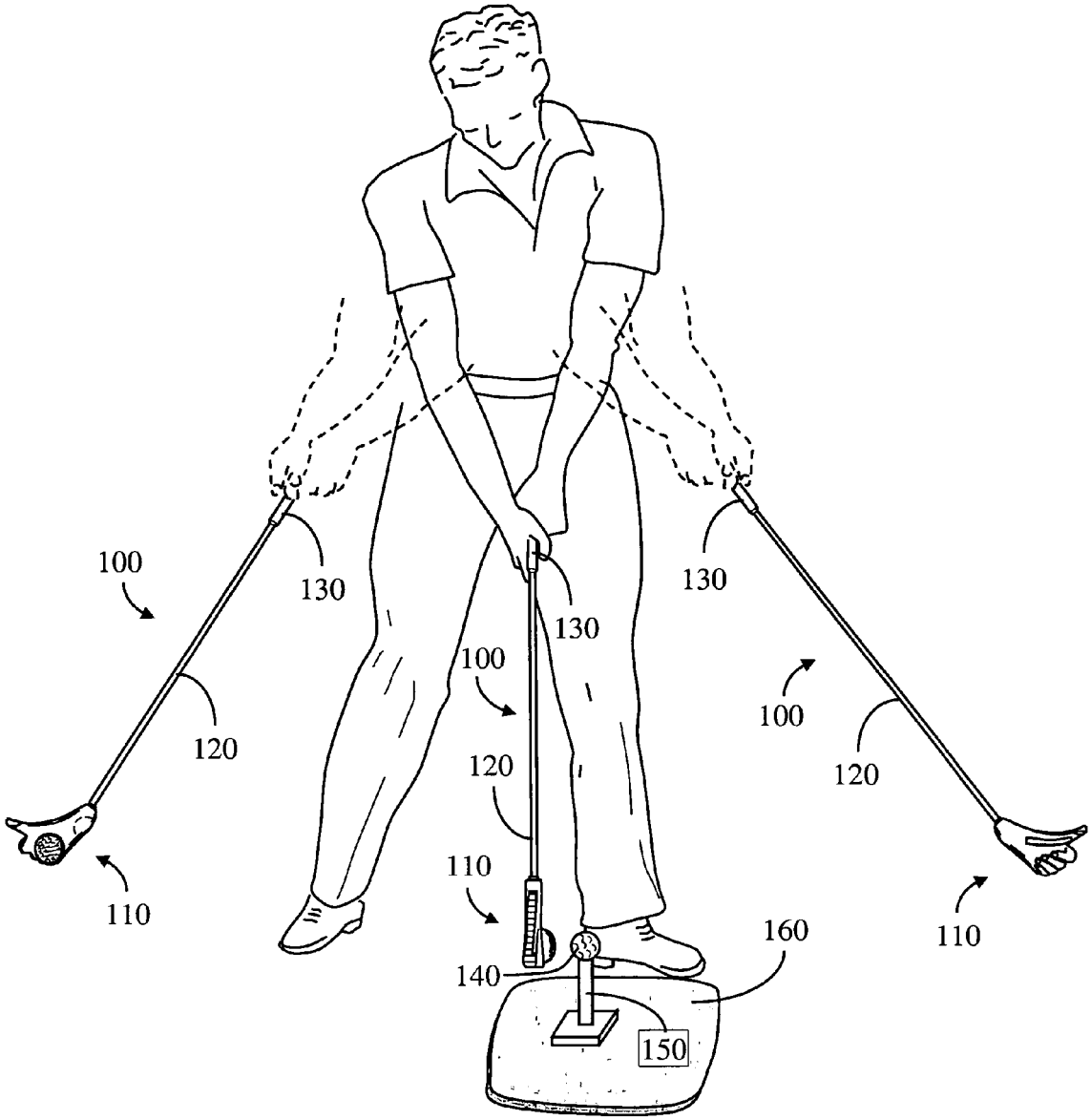
FIG. 1 is a perspective view of a golfer using a training golf club of the present invention.

The training golf club 100 of the present invention is shown in use in FIG. 1. One aspect of the training golf club 100 is its hand shaped head 110. Specifically, the head 110 is shaped like and represents the leading hand of the golf trainee. The golfer's leading hand is the left hand if the golfer golfs right handed, and is the right hand if the golfer golfs left handed. The hand-shaped training golf club head 110 has a "palm" side, a "back side" opposite the palm side, a "thumb," and "fingers." The "heel" of the training golf club head 110 is defined herein as the side opposite the thumb. The toe of the training golf club head 110 is defined herein as the side opposite the heel, so the thumb is in the toe region as shown in FIG. 1.

The training golf club head 110 is specifically shaped as a leading hand to encourage the golf trainee to envision impacting the golf ball 140 with the back of the golf trainee's leading hand.

The shaft 120 and grip 130 of the training golf club 100 are shaped like those of ordinary golf clubs well known by those of ordinary skill in the art. The lower portion of the grip 130 is specially colored as shown in FIGS. 2–5, to aid in training a golfer to release properly.

Figure 4:
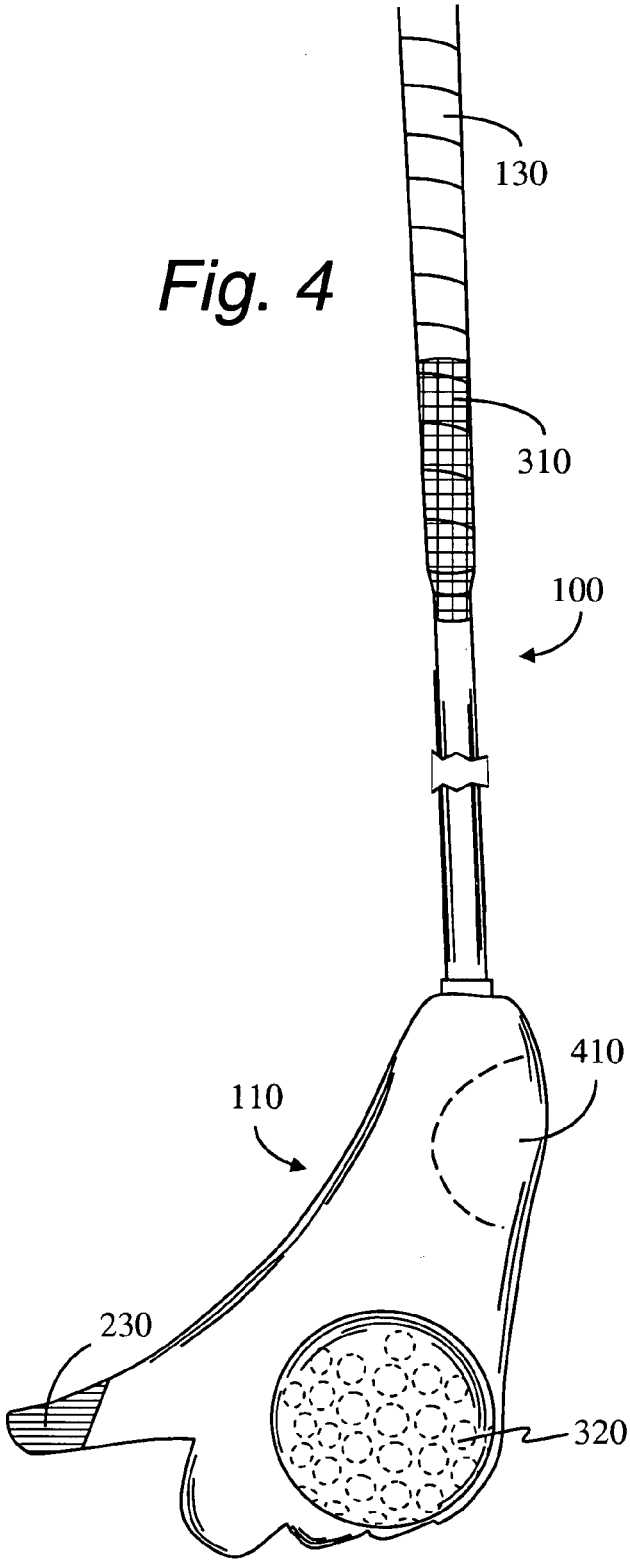
FIG. 4 is a second side elevation view of the training golf club.
Figure 5:
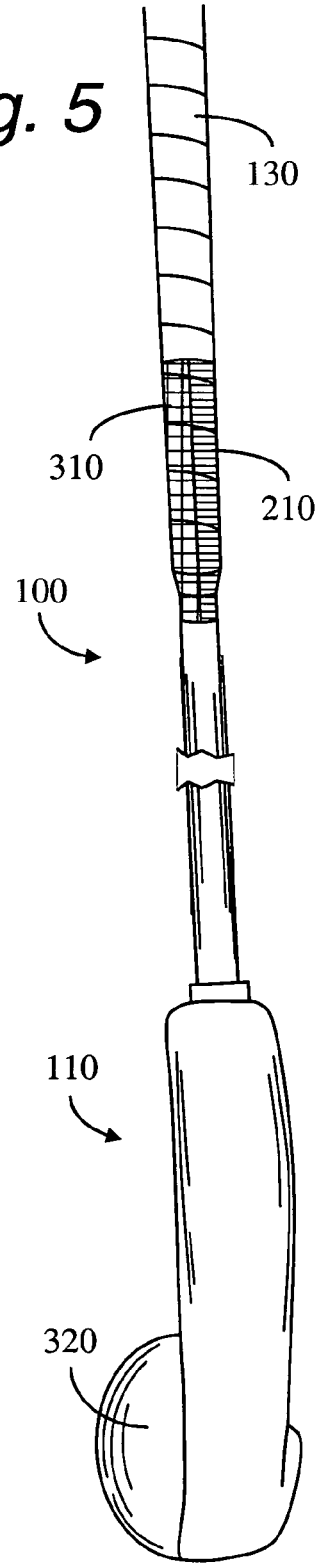
FIG. 5 is a rear elevation view of the training golf club.

Specifically, in a preferred embodiment, a blue region 210 of the lower grip 130 corresponds to the palm side of the shaped training golf club head 110 as clearly shown in FIGS. 2, 3, and 5. A yellow region 310 corresponds to the back of the hand-shaped training golf club head 110 as shown in FIGS. 3, 4, and 5.

The golf trainee will observe the color indications 210, 310 after impact to help improve their release.

On the hand-shaped training golf club head 110, itself, a blue stripe 220 is applied to the palm side and an additional blue region 230 is applied down the thumb side.

The stripe 220 on the palm region is seen by the golf trainee after impact. This will also aid in practicing a proper release.

The thumb color 230 will visually guide the golf trainee to a proper swing plane on the back swing. When the thumb points straight up the back swing is "on plane."

A protrusion 320 sized and shaped as one hemisphere of a golf ball makes up a portion of the back of the hand-shaped training golf club head 110.

The heel portion of the training golf club head 110 is made to be denser than the remainder of the training golf club head 110 by adding extra weight 410 to the training golf club head 110 in the vicinity of the training golf club head heel.

The denser heel compared to the toe of the training golf club head 110 is made to encourage the rotation of the training golf club head 110 during the swing. A right handed golfer will rotate the training golf club head 110 counter-clockwise while a left handed golfer will rotate the training golf club head 110 clockwise. The rotation is carried out by the golfer's leading hand.

The hand-shaped head 110 of the training golf club 100 may be weighted to provide strength training for the golf trainee. In the preferred embodiment, the weight of the head 110 is between two (2) and ten (10) pounds.

Additional, optional components of a golf training system include a rubber tee 150 resting on or affixed to a swing mat 160. The golf ball 140 is preferably firmly attached to the rubber tee 150 for practice swings.

The above embodiment is the preferred embodiment, but this invention is not limited thereto. It is, therefore, apparent that many modifications and variations of the present invention are possible in light of the above teachings. It is, therefore, to be understood that within the scope of the appended claims, the invention may be practiced otherwise than as specifically described.

I claim:

1. A training golf club comprising a shaft;

a grip operatively, rigidly affixed to the shaft; and a hand-shaped head to encourage a golfer to envision impacting a golf ball with a golfer's leading hand, wherein the hand-shaped head includes: a palm region, a back region opposite the palm region, a thumb region, and a heel region opposite the thumb region;

a first color on a first side of the grip, said first side of the grip corresponding to the palm region of the training golf club head; and a second color different from the first color, on a second side of the grip, opposite the first side of the grip, said second side of the grip corresponding to the back region of the training golf club head.

2. The training golf club of claim 1 additionally comprising formed protrusions shaped as fingers.

3. The training golf club of claim 1 additionally comprising a formed protrusion located the back region, said formed protrusion being hemispherically shaped and sized substantially as the golf ball.

4. The training golf club of claim 1 additionally comprising a weighted heel portion, said weighted heel portion being on average denser than the thumb region.

5. The training golf club of claim 1 additionally comprising a colored stripe on the thumb region to visually guide the golfer to a proper swing plane on the back swing.

6. The training golf club of claim 1 additionally comprising a colored stripe on the palm region to visually guide the golfer to a proper release.

7. A method of constructing a training golf club comprising a shaft, a grip, and a head, said method comprising:

shaping the head substantially as a leading hand of a golfer;

shaping a hemispherical substantially golf ball shaped and sized protrusion on a back of the hand-shaped head;

operatively, rigidly affixing the head to the shaft;

operatively, rigidly affixing the grip to the shaft;

coloring a first side of the grip a first color, said first side of the grip corresponding to a palm region of the hand-shaped head; and coloring a second side of the grip a second color distinct from the first color, said second side of the grip being opposite the first side of the grip.

8. The method of claim 7 additionally comprising applying a color to a palm region of the hand-shaped head different from colors used on parts of the hand-shaped head outside the palm region.

9. The method of claim 7 additionally comprising applying a color to a thumb region of the hand-shaped head different from colors used on parts of the hand-shaped head outside the thumb region.

10. A method of using a training golf club having a leading hand-shaped head, a shaft, and a grip, the method comprising:

coloring a thumb region of the hand-shaped head;

coloring the grip with two distinct colors, a first distinct color on a side of the grip corresponding to a palm region of the hand-shaped head and a second distinct color opposite the first color;

coloring the palm region of the hand-shaped head;

watching the color of the thumb on a backswing;

pointing the thumb straight up for an on-plane backswing;

rotating the training golf club during a swing;

noting a passing of the two distinct colors of the grip while rotating the training golf club; and noting an appearance of the color on the palm region of the hand-shaped head upon release.

* * * * *